US008925632B2

(12) United States Patent
Bunio et al.

(10) Patent No.: US 8,925,632 B2
(45) Date of Patent: Jan. 6, 2015

(54) IN SITU PROCESS TO RECOVER METHANE GAS FROM HYDRATES

(75) Inventors: Gary Bunio, Calgary (CA); Ian Donald Gates, Calgary (CA); Jacky Wang, Calgary (CA)

(73) Assignee: MGM Energy Corp., Calgary, Alberta (CA)

( * ) Notice: Subject to any disclaimer, the term of this patent is extended or adjusted under 35 U.S.C. 154(b) by 522 days.

(21) Appl. No.: 13/314,344

(22) Filed: Dec. 8, 2011

(65) Prior Publication Data

US 2012/0145388 A1 Jun. 14, 2012

Related U.S. Application Data

(60) Provisional application No. 61/421,266, filed on Dec. 9, 2010.

(51) Int. Cl.
*E21B 43/20* (2006.01)
*E21B 43/30* (2006.01)
*E21B 43/01* (2006.01)

(52) U.S. Cl.
CPC ..... *E21B 43/20* (2013.01); *E21B 43/305* (2013.01); *E21B 2043/0115* (2013.01)
USPC ..... 166/268; 166/50

(58) Field of Classification Search
USPC ..... 166/268, 275, 50, 369, 304, 90.1
See application file for complete search history.

(56) References Cited

U.S. PATENT DOCUMENTS

| | | | | |
|---|---|---|---|---|
| 4,262,747 | A * | 4/1981 | Elliott et al. | 166/297 |
| 6,817,427 | B2 | 11/2004 | Matsuo et al. | |
| 7,165,621 | B2 | 1/2007 | Ayoub et al. | |
| 7,530,392 | B2 | 5/2009 | Sugiyama et al. | |
| 8,235,110 | B2 * | 8/2012 | Larter et al. | 166/250.01 |
| 2008/0060807 | A1 * | 3/2008 | Zupanick | 166/252.1 |
| 2008/0121393 | A1 * | 5/2008 | Pfefferle | 166/257 |
| 2012/0145388 | A1 * | 6/2012 | Bunio et al. | 166/275 |
| 2014/0008063 | A1 * | 1/2014 | Prentice, III | 166/272.3 |

FOREIGN PATENT DOCUMENTS

| | | | |
|---|---|---|---|
| WO | WO02/085821 | A2 | 10/2002 |
| WO | WO2007/117167 | A1 | 10/2007 |

* cited by examiner

*Primary Examiner* — Daniel P Stephenson
(74) *Attorney, Agent, or Firm* — Norton Rose Fulbright Canada LLP

(57) ABSTRACT

This invention consists of a method to enable methane recovery from hydrate reservoirs. The invention, in particular, relates to a Saltwater Hydrate Extraction Process (SHEP) in which high salinity water is injected into a hydrate reservoir into a lower horizontal well to promote and control gas production by hydrate decomposition to an upper deviated production well.

17 Claims, 11 Drawing Sheets

IN SITU PROCESS TO RECOVER METHANE GAS FROM HYDRATES

FIELD OF THE INVENTION

The current invention pertains to the field of gas recovery from hydrate reservoirs. Specifically the process includes horizontal parallel and non parallel wells and the injection of saline water into one of the wells.

BACKGROUND TO THE INVENTION

Gas Hydrates are a form of ice crystal which contains molecular Methane ($CH_4$) encased in the ice's molecular lattice. Methane hydrates may contain up to 160 cubic feet of gas for each cubic foot of hydrate at standard conditions.

It is well known that hydrate destabilizes to methane gas and water with addition of heat and depressurization. It is less well known that an increase of the salinity of water in equilibrium with the hydrate phase will also destabilize the hydrate. FIG. 1 displays the effect of pressure, temperature, and salinity on the methane hydrate envelope. The plot shows that the higher the temperature, the lower the pressure, and the higher the salinity, the higher likelihood of hydrate destabilization. Most proposed methods for methane production from hydrates use addition of heat or depressurization of the reservoir. However, these are energy intensive processes. At a given pressure and temperature, the alternative is to raise the salinity of the water phase in equilibrium with the hydrate.

The current method for the extraction of the hydrates comprises drilling of vertical wells for injecting of the water and for gas production. Injecting the water, warm water and/or saline water into the well and after release of the gas retrieval of the gas from the production well and its collection by the methods known in the art.

There are several configuration of the injection well and production well known in the art. U.S. Pat. No. 6,817,427 by Matsuo teaches the extraction pipe surrounding the perimeter of the injection pipe. WO 2007/117167 by Bacui, teaches wells which are vertical and parallel to each other. U.S. Pat. No. 7,165,621 by Ayoub, teaches vertical injection wells and also horizontal extraction wells. However this patent does not discuss benefits of such configurations.

All these configurations have one common deficiency: namely the well location does not provide optimal extraction of the methane from the deposit. These configurations do not address the gas which accumulates in underground cracks and pockets proximate to the wells. These configurations do not address the extraction of the gas through the entire thickness of the deposit. Most of the time in order to continuously retrieve methane from the deposit there is a requirement to drill additional wells. This procedure increases the constructing and the operational costs of the facility.

Therefore there is a need for a method of effectively extracting gas from a hydrate deposit through the whole process of recovery.

There is a need for a method of gas extracting with minimal drilling requirements.

There is a need for a process of gas extraction which promotes the growth of the depletion chamber to maximize the recovery of the hydrate from each hydrate deposit.

SUMMARY OF THE INVENTION

A new recovery process is disclosed where the salinity of the water in the hydrate formation is raised. The well configuration is designed to promote the growth of a depletion chamber in the hydrate formation. The requirements of the salinity of the injected water depend on the salinity of the water in equilibrium with the hydrate in the formation. If the water salinity is lower than that of sea water, then sea water can be used to decompose the hydrate. Alternatively, high salinity water from other formations, for example, deeper formations, can be used.

The new in situ reservoir recovery process consists of a horizontal injection well and a directionally-drilled production well to extract gas from a hydrate reservoir as shown in FIG. 2. The injection well is placed near the base of the hydrate zone. The interwell separation at the toes of the wells is of order of 5 to 10 m. This well configuration promotes and controls the growth of a depletion chamber within the formation. FIG. 6 illustrates the evolution of the new process.

High salinity water is injected into the formation into the toe of the lower well. Since the salinity of the water is now raised, at fixed pressure and temperature, the hydrate phase decomposes to produce water and methane and a depletion zone is created. The gas segregates to the top of the depletion chamber whereas the water stays closer to the bottom of the reservoir. These fluids are then produced from the depletion chamber by using the upper production well. Gas may be produced from a free gas cap that forms at the top of the depletion chamber or be entrained with produced water below the gas-water contact.

High salinity water is injected at a rate sufficient to displace the fresher water that results from hydrate decomposition into the production well. Thus, the water zone at the base of the depletion zone is largely filled with injected high salinity water which continues to decompose hydrate at the edges of the depletion chamber. Gas is produced at the top of the depletion zone at a rate that controls the gas volume in the formation so that the contact area of high salinity water at the base of the depletion chamber is maximized. The production well rate also controls the growth of the depletion chamber along the well pair. Since gas always rises to the top of the depletion chamber and gas-water segregation is gravity stable, the upper production well has to traverse the thickness of the hydrate reservoir to enable continued production of gas. If the top production well was horizontal, there was a possibility that the gas cap will exist above the elevation of the well and only water will be produced from the formation. The decomposition of hydrate lowers the temperature at the edge of the depletion chamber in the hydrate reservoir. This reduced temperature resists the decomposition of the hydrate by saline water injection.

According to one embodiment of the invention, there is provided a method to recover methane gas from an underground hydrate reservoir that has been penetrated by injection and production wells, the method comprising the steps of:

a) Drilling a saline water injection well proximate the base of the hydrate reservoir.
b) Drilling a substantially non parallel production well that at some location along its length is within 1 to 10 m from a part of the injection well.
c) Initially injecting saline water into the production well which creates a depletion chamber between the injection and production wells.
d) Varying the injection procedure for saline water, for example preferably varying at least one of injection pressure, injection rate, temperature, or salinity, to propagate a depletion chamber in the hydrate formation resulting from hydrate decomposition.
e) Extraction of gas and water from the depletion chamber through the production well.

Preferably, this method further has a step of monitoring and varying the injection pressure and temperature to enhance propagation of the depletion chamber and extraction of gas. The method also has a step of monitoring and changing the extraction rate to alter the pressure and temperature of the depletion chamber, its propagation and extraction of gas. Still preferably the method has a step of monitoring and changing the salinity of the injected water to enhance propagation of the depletion chamber and extraction of gas. It is also likely to have an additional step where injection is stopped and gas is continually extracted from the reservoir.

According to another aspect of the invention, there is provided a method for recovery of methane gas from an underground hydrate formation. The method requires establishing of at least one pair of generally non parallel wells: a lower injection well and an upper production well. The injection well delivers saline water to the formation, and the production well recovers gas and water from the formation. In this arrangement, a depletion chamber is created pursuant to the operation of the well pair, starting at the point of the minimal distance between the wells.

In a preferred embodiment, the injection well extends horizontally proximate a lower part of the hydrate formation and the production well extends above the injection well. The vertical distance between the injection well and the production well varies from a minimal distance of 1 to 10 meters to a maximum distance of the thickness of the hydrate formation.

In one preferred embodiment the heel of the production well is located proximate to the top of the hydrate deposit and its toe is located 1 to 10 meters above the toe of the injection well. The production well extends between its heel and its toe at an angle to the injection well.

In the second preferred embodiment, the heel of the production well is located 1 to 10 meters above the heel of the injection well and its toe is located proximate the top of the hydrate deposit above the toe of the injection well. The production well extends between its heel and its toe at an angle to the injection well.

In yet another embodiment, the heel of the production well is located above the heel of the injection well at a distance between 1 meter up to the top of the hydrate deposit, and the toe of the production well is located above the toe of the injection well at a distance selected from 1 meter up to the top of the hydrate deposit. The production well extends between its heel and its toe substantially non parallel to the injection well. Further there is at least one intermediate segment of the production well positioned between the heel and the toe which is located 1 to 10 meters from the injection well. Preferably, the angle between the production well and the injection well varies between the head of the well to the toe of the well, therein there is one angle before the intermediate point and another angle beyond it.

According to yet another aspect of the invention the methods described above also have a step of a heated saline water injected into the injection well and the produced gas and water are retrieved from the production well.

Preferably there is a step in the methods described above when the output of the production well is shut, and only the injection well is operable, while in yet another step the inlet to the injection well is shut, and only the production well is operable.

According to still another aspect of the invention there is provided a process for extracting methane gas from a hydrate deposit, the process comprising the following steps:

a) drilling two generally non parallel wells: a lower injection well and an upper production well, b) injecting into the lower well heated saline water to create a depletion chamber, c) waiting for separation of the gas and water phases, d) extracting of the gas and water from the deposit, e) separating the gas from the water, and f) reusing the water for further injection.

Preferably, this process has a lower well which extends substantially horizontally at the bottom of the hydrate deposit, and the upper well which extends at an angle to the lower well. The vertical distance between the wells varies from 1 meter up to the top of the hydrate deposit, and in this way gas can be extracted from any location in the depletion chamber.

According to another aspect of the invention, there is provided a system for extracting methane gas from a hydrate deposit, the system comprising an injection well, a production well, a water injecting unit, and a gas collecting unit. The injection well extends vertically from the injection point toward the bottom of the hydrate deposit and then extends horizontally along the hydrate deposit's bottom. The production well extends vertically from the ground to the top of the hydrate deposit and then extending in a non parallel direction above the injection well. Further at least one segment of the production well being located proximate the injection well and the balance of the production well being positioned in the hydrate deposit remote from the injection well. Finally, the water injecting unit is attached to the injection well and the gas collecting unit is attached to the production well.

Preferably, the system, process or method described above further comprises a movable packer in the production well.

The method described herein can also inject saline water heated to about +5° C. above the reservoir temperature to deal with the heat required to offset that needed to decompose the hydrate.

One advantage of the well configuration is that it promotes the field-wide production of hydrate in that additional deviated production wells can be drilled beyond the heels and toes of an existing well pair and the lower injection well from the existing well pair and can be used to feed the new production wells.

Another advantage of this well configuration is that it deals with both thin and thick hydrate deposits.

One other advantage of the method is that the injected high salinity water can be heated to promote further degradation of the hydrate.

Another advantage of the method is that it can be operated in a cyclic manner. In this approach, the high salinity water is injected into the formation with the production well shut in. After the target pressure or volume of high salinity water is injected, the injection well is shut in and the production well is opened. The action of the high salinity water plus production will cause multiple effects including the decomposition of the hydrate plus a pressure transient that will enhance hydrate decomposition and gas production.

One other advantage is that the produced gas is easily separated from the produced fluids stream. Also, since the produced water has lower salinity than the injected water, then it can be easily disposed of.

One other advantage is that carbon dioxide could be co-injected with the water for solubility trapping of carbon dioxide in the depletion chamber.

One other advantage of the well configuration is that movable packers or interval control valves can be used in one or both of the wells to manage the depletion growth along the well pair.

Further advantages would be apparent from the provided illustrations, examples and claims.

DETAILED DESCRIPTION OF THE PREFERRED EMBODIMENTS

Figure 1:
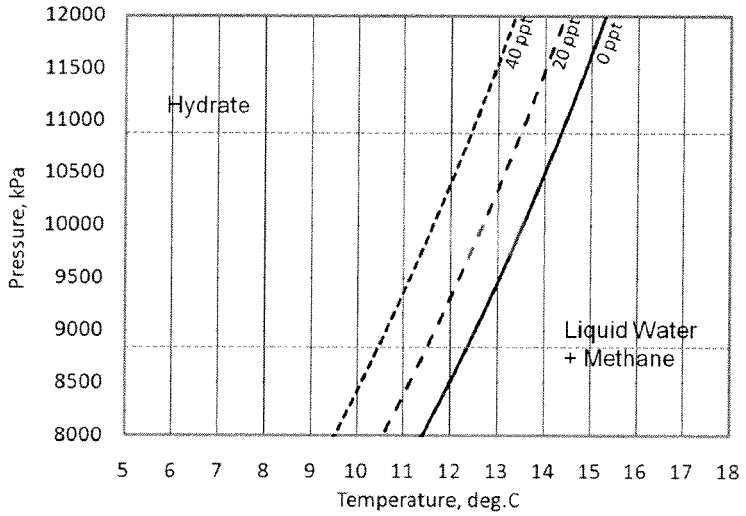
FIG. 1 Table illustrating temperature, pressure and salinity effect on the hydrate extraction.

Some of the deficiencies of processes known in the art are addressed in the current invention.

Firstly this process eliminates the risk of fracturing the deposit resulting in loss of the gas to the underground cracks and pockets leaching to the surface.

Secondly, hydrate recovery processes must provide means to not only decompose hydrate but also deliver the produced gas to a production well. This means that the recovery process must separate the gas within the reservoir and provide a direct hydraulic connection between the gas in the reservoir and the production well. The current process guarantees this since the production well spans the entire thickness and a significant area footprint within the reservoir. Processes that use vertical wells do not have large area footprint and processes that use horizontal wells only access up to the elevation of the horizontal well (a gas pocket that sits above the horizontal well can never be produced to surface).

Further, hydrate recovery processes must provide a means to continuously supply the decomposing 'agent' (heat, salt water, depressurization) to the reservoir. The current process does this by growing the chamber with circulating warm salt water. Thus the salt and heat are continuously replenished and due to decomposition, the diluted salt water is continuously removed from the depletion chamber and replaced by injected warm salt water. For fracture-based recovery processes, after the fracture is created, unless the decomposing agent is continuously supplied to the fracture, the depletion chamber does not grow.

With reference to the figures, a Saltwater Hydrate Extraction Process (SHEP) in which high salinity water is injected into a hydrate reservoir into a lower horizontal well to promote and control gas production by hydrate decomposition to an upper deviated production well is described. Broadly, the invention consists of a new well configuration and novel injection strategy that results in significantly improved methane gas production from a hydrate reservoir.

Hydrate is solid at in situ initial reservoir temperatures and pressures. At elevated temperatures or reduced pressures, hydrate will decompose to produce liquid water and methane gas. Also, at elevated saline conditions, hydrate will decompose to yield liquid water and methane gas. The first requirement for a successful hydrate recovery process is the requirement that either one or more of the following conditionings must be present in the reservoir. First, heat addition which can be in the form of a heated injectant such as hot water or steam. Second, pressure reduction can be accomplished by removing fluids from the reservoir. Third, a salinity level increase can be realized for example by injecting high salinity water into the hydrate reservoir or by any other method known in the art.

The second requirement for a successful hydrate recovery process is the requirement that the gas generated by hydrate decomposition must be delivered to a production well to bring it to surface. When the hydrate decomposes, the liquid and water segregates under the action of gravity: the liquid descends to the base of the depletion chamber whereas the gas rises to the top of the depletion chamber. To produce gas, the production well must remain in contact with the gas zone otherwise, if it is located in the water zone, then only water will be produced from the reservoir. Thus the well configuration in a successful hydrate recovery process must allow injection of heat or saline water or removal of fluids to lower pressure or combinations of all yet allow gas movement to a production well.

Herein, the method described may use saline water injection warmed to offset the heat of melting required as the hydrate decomposes. As the depletion chamber grows in the hydrate reservoir, it provides a natural means to separate injected water and decomposed-hydrate water and hydrate-generated gas: under the action of gravity, the density contrast between the vapour and liquid allows phase separation. To continuously produce gas from the reservoir, it is also required that the depletion chamber expands to ensure that fresh hydrate is accessed by injected saline water.

Another important part of the invention is the orientation of the wells, the location of the wells in the deposit and their relative position to one another. There is at least one injection well and at least one production well. The production well is located above the injection well to collect the gas released from the hydrate. The production well is also used for removal of the water from the chamber. The wells can be parallel in the segment (leg of the well) from the ground surface to the heels of the wells while in the production zone (foot of the well) from heels to toes the wells are substantially non parallel to each other, or non parallel at least along some of the segments of the wells. The wells can be drilled in generally straight lines, angled lines and lines with variable angles to address the specific limitations of the deposits. While the injection well in its production zone (foot of the well) extends substantially horizontally and located toward the bottom of the deposit. The production well is at its production zone angled to the injection well and this angle may vary several times along the production well extension.

Figure 2:
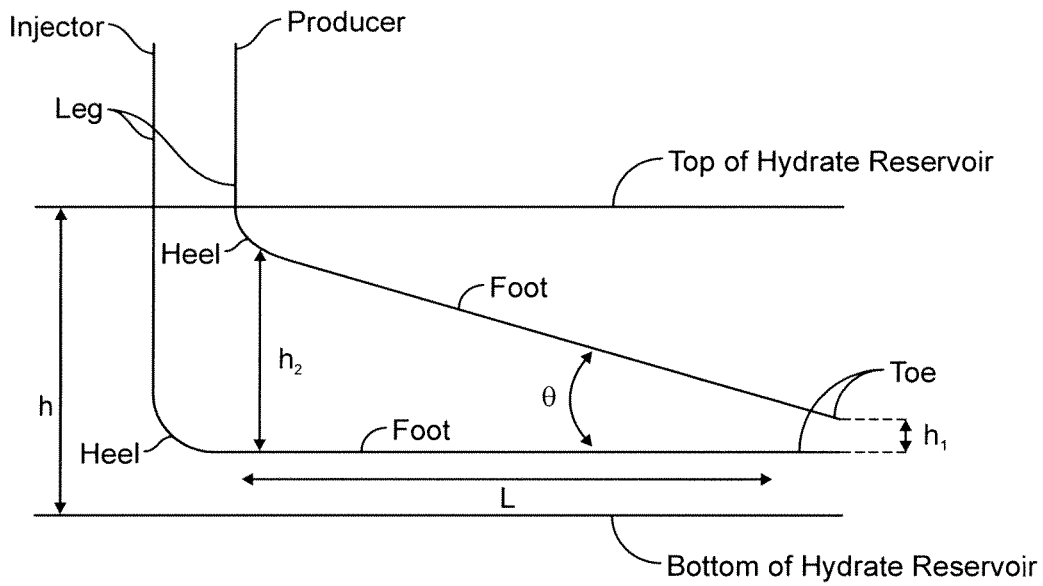
FIG. 2 illustrates a schematic side view arrangement of the first embodiment of the invention.
Figure 6:
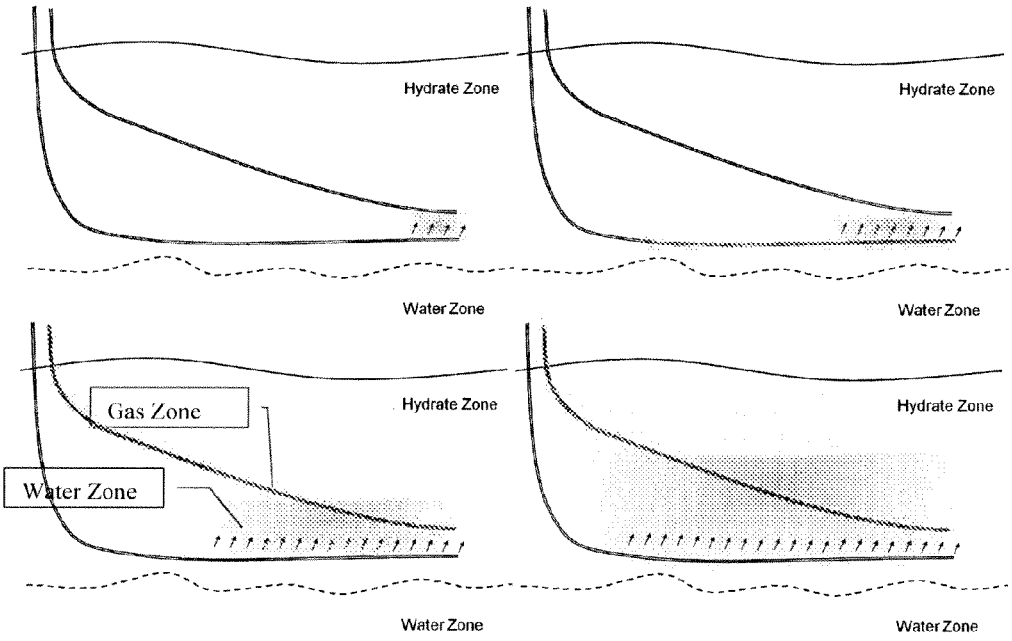
FIGS. 6-9 illustrate a schematic side view of the grow of the depletion chamber.
Figure 7:
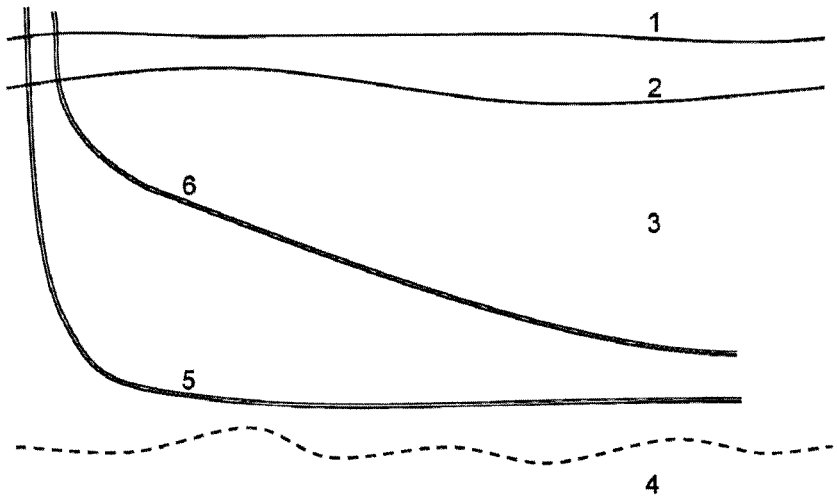
Figure 8:
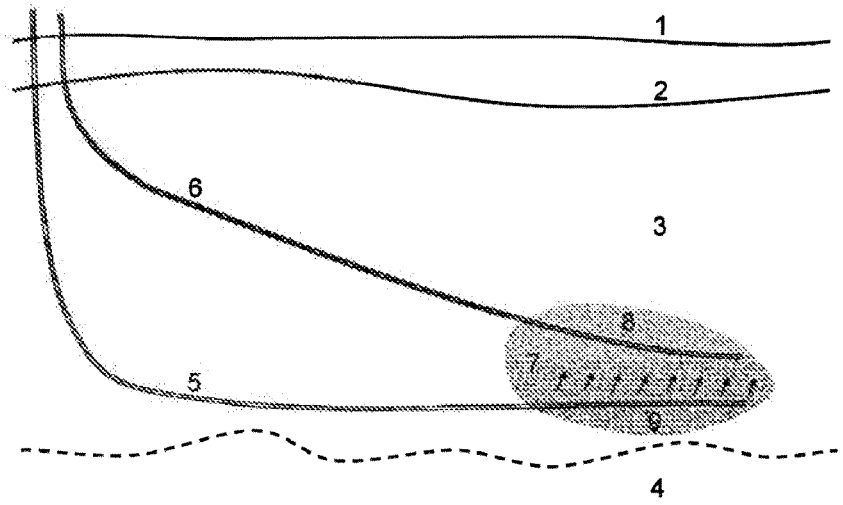
Figure 9:
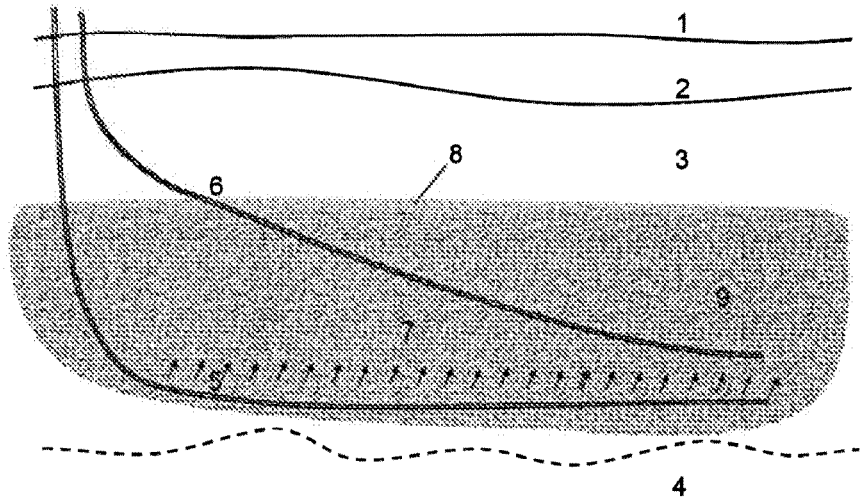
Figure 10:
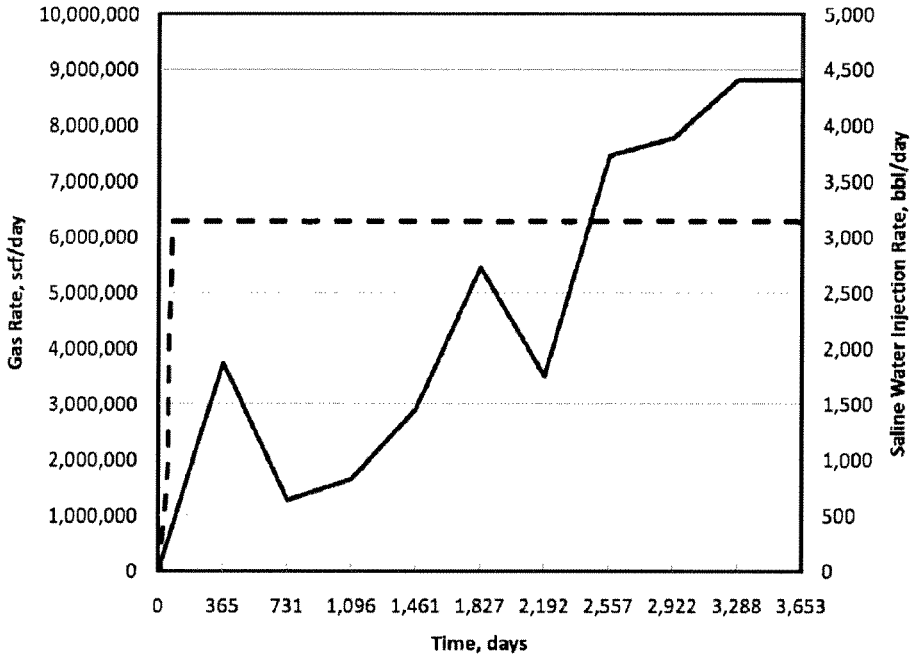
FIG. 10 illustrates projected gas production rate as function of salt water injection rate.

In accordance with this invention, as shown in FIGS. 2 and 7, a horizontal injection well 5 is drilled into the hydrate reservoir 3 penetrating the surface of the earth 1 and the overburden 2. The reservoir is bounded by the bottom of the overburden 2 and the top of the understrata 4. The understrata 4, given geothermal gradients, consists of a water-rich zone. Above the reservoir 3 is the overburden 2 which consists of any one or more of shale, rock, sand layers, and other formations such as aquifers. A directionally drilled well 6, drilled so that its toe is positioned one to several meters above in vertical alignment with the toe of the production well 5 is also drilled into the reservoir 3. In the present invention, as shown in FIG. 8, saline water injected through the injection well 5 into the hydrate reservoir 3, flows from the injection well 5 into the depletion chamber 7 surrounding the injection well 5. By injecting warm saline water into the reservoir 3, saline water and heat are transmitted to the reservoir 3 and eventually reaches the edge of the depletion chamber 7 and contacts the virgin hydrate in the reservoir 3. The saline water causes the solid hydrate to decompose yielding liquid water and methane gas. The water flows under gravity and occupies the lower part of the depletion chamber, denoted 9 in FIG. 5, whereas the gas rises and occupies the upper part of the depletion chamber, denoted 8 in FIG. 5. The withdrawal rate of the production well 6 is controlled to remove both liquid water and gas from the depletion chamber to the surface 1. This rate is set to a value to prevent excessive dilution of the injected saline water by the hydrate-decomposed generated water. Also, the production rate has to be controlled so that the vapour phase volume, denoted 8 in FIG. 5, in the depletion chamber is small or nearly zero so that injected saline water can contact the top of the growing depletion chamber. FIG. 9 displays a schematic of the process at a later stage of its production life following the expansion of the depletion chamber 9. The steps of the growth of the depletion chamber are illustrated in FIG. 6.

In the first embodiment of the invention best illustrated in FIG. 2, the trajectory of the directionally-drilled production well 6 is chosen so that it spans the entire thickness of the hydrate reservoir yet its toe is in close proximity to the toe of the injection well. The dimensions of the wells are dependent on various factors such as the geological conditions of the deposit, size of the deposit, depth, etc. The general dimensions are as following: $h_1$ is a vertical displacement between the toe of the injection well and the toe of the production well. The distance $h_1$ is between 0.5 and 10 m, and preferably between 1 and 5 m. Item $h_2$ is a thickness of the hydrate reservoir (minus offset of injection well from the base of reservoir) which can be measured by the methods known in the art. The injection well extends from heel to toe and substantially horizontally and its span (L) is between 50 and 1500 m, preferably between 100 and 1000 m. $\theta$ is an angle between the injection well to the production well. This angle is between 0.5 and 45°, preferably between 1 and 10°. Item h is the thickness of the hydrate reservoir; this thickness can be highly variable and usually extends between 20 and 200 m.

Figure 3:
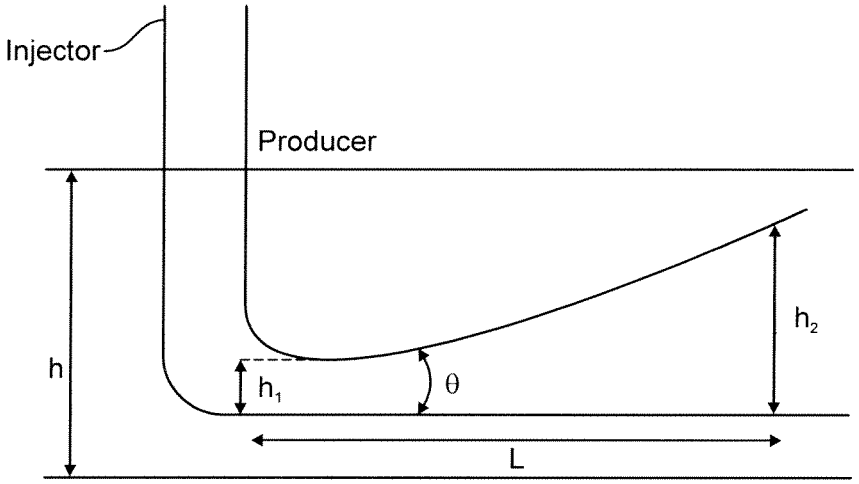
FIG. 3 illustrates a schematic side view arrangement of the second embodiment of the invention.

In the second embodiment of the invention as illustrated in FIG. 3, the production well has a different orientation to address the geological conditions of the hydrate deposit. Wherein the minimal distance $h_1$ between the injection well and the production well is at the heel part of the wells and the distance between the two increases toward the toes of the wells $h_2$. "$h_1$" is between 0.5 and 10 m, and preferably between 1 and 5 m while $h_2$ is approximately equal to the thickness of the reservoir. The angle $\theta$ again is between 0.5 and 45°, preferably between 1 and 10°.

There are several viable options for the well geometries, in the preferred embodiment, since one goal the goal of the technology is to grow a depletion chamber starting from a point along the wells where the interwell ($h_1$) distance is relatively small (1 to 10 m, preferably 1 to 5 m) and then along the trajectory of the wells. Further it is important to note, that the trajectory of the well pairs do not have to be in a vertical plane either—they could diverge from each other laterally (in the horizontal direction) thus creating a depletion chamber that extends laterally in the reservoir.

Figure 4:
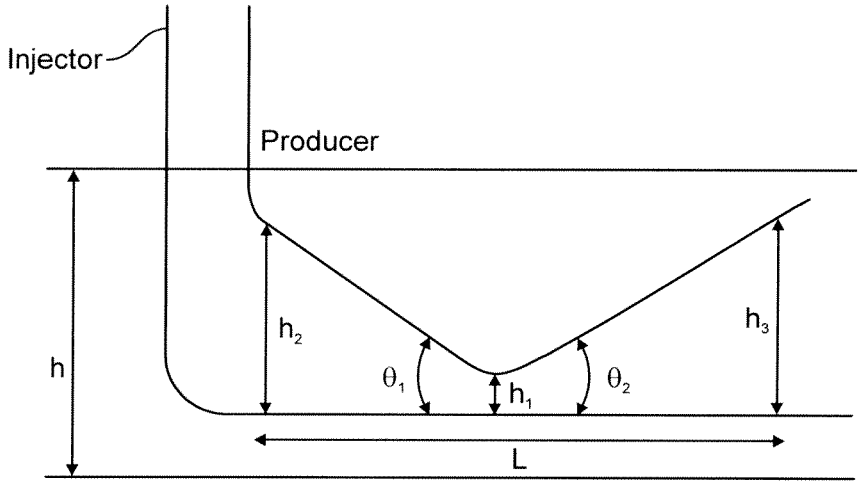
FIG. 4 illustrates a schematic side view arrangement of the third embodiment of the invention.
Figure 5:
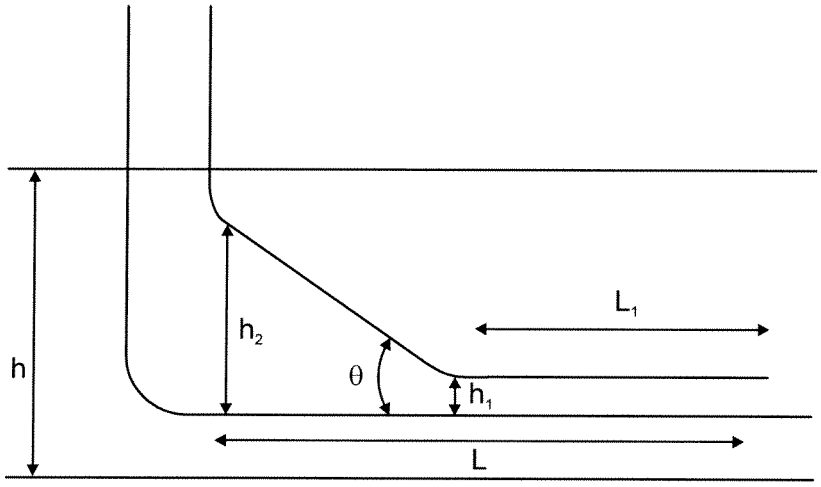
FIG. 5 illustrates a schematic side view arrangement of the fourth embodiment of the invention.

In yet another embodiment of the invention the point along the well pair where the depletion chamber is started need not be at the heel as shown in FIG. 3 or toe as shown in FIG. 1 of the well but it might be in any point along the well pair for example as displayed in FIG. 4 and FIG. 5. These figures illustrate additional embodiments of non parallel and partially parallel well pair geometries. The distances h, $h_1$, $h_2$ are in the same ranges as in the above mentioned first embodiment, range of $h_3$ being similar to $h_2$ while the slope angles $\theta_1$, $\theta_2$ are in the same range of values as $\theta$. The horizontal segment of $L_1$ in FIG. 5 is between 20 and 1200 m, and preferably between 20 and 100 m.

In yet another embodiment of the invention a tubing string might be positioned in the production well that ends at the toe of the well (the well of the third embodiment in FIG. 4). This tubing arrangement can remove fluids from the heel and the toe simultaneously thus making the process potentially more efficient (two removal points instead of one). The chamber would grow outwards from the position ($h_1$) (see FIG. 4) along the well pair in both directions. Coiled tubing strings are standard well technology. Further, a movable packer can be located in the production well to guide the growth of the chamber.

Figure 11:
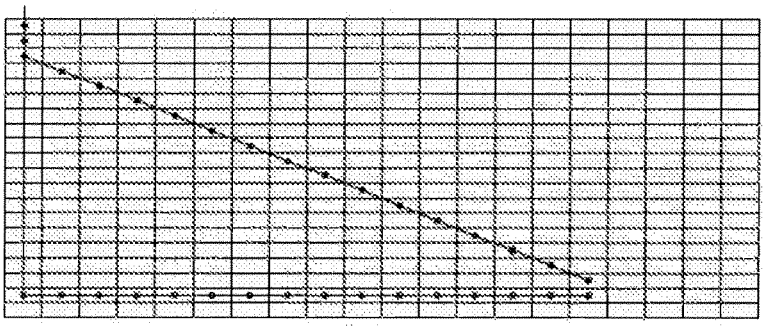
FIG. 11 illustrates the arrangement of the wells in the CMG-STARS simulation.

In FIG. 7, a typical injection and production profile for saline water and methane gas is displayed for a well pair of 800 m length. These profiles have been simulated by using a commercial thermal reservoir simulator CMG-STAR where the thermodynamics of hydrate formation and decomposition versus pressure, temperature, and salinity are taken into account. FIG. 11 displays the well configuration used for the simulation. The top well is the production well whereas the bottom well is the injection well.

At the start of the process, hot water may be circulated in both the injection 5 and production 6 wells to promote heating between the wells. The closest inter-well spacing is at the toes of the wells and thus the region at the toes of the wells will be warmed the most between the wells. This heating causes the decomposition of the hydrate between the toes of the wells which initiates the start of the depletion chamber there. Once the depletion chamber has been established, the saline water is injected into the injection well 5 and fills the depletion chamber. Once in contact with saline water, hydrate at the edge of the chamber will decompose thus extending the volume of the chamber as shown in FIG. 8.

To offset the heat needed to melt the hydrate, the injected saline water can be heated by a few degrees above the chamber temperature, preferably +5° C. or less. The injection rate of saline water and production rate of water is maintained high to motivate gas movement to the production well 6 and to maintain as little or no gas at the top of the depletion chamber. However, the pressure is maintained in the depletion chamber at or below the original reservoir pressure. This ensures that hydrate decomposition is not prevented by an increase of the pressure in the hydrate reservoir. Operating of the depletion chamber at pressure lower than that of the original reservoir pressure promotes hydrate decomposition and enhances the rate of gas generation from the system.

As the process evolves, the chamber reaches the top of the hydrate reservoir and thereafter spreads laterally outwards from the injection/production well pair. The process can be operated with several injection and production well pairs in a field coordinated to realize a targeted depletion chamber growth plan in the hydrate reservoir.

The amounts of the saline water injected and water produced and the injection pressure are chosen so that the decomposition of hydrate is maximized.

As the chamber 7 grows, as displayed in FIG. 9, heat losses to the overburden 2 increase because the greater exposed area of the heated vapour chamber 7 to the colder overburden. However, a thin gas blanket 8 will be maintained at the top of the depletion chamber 7 above the perforations of the production well 6. This gas blanket will insulate the heated water zone from the cold overburden thus increasing the thermal efficiency of the process.

Figure 12:
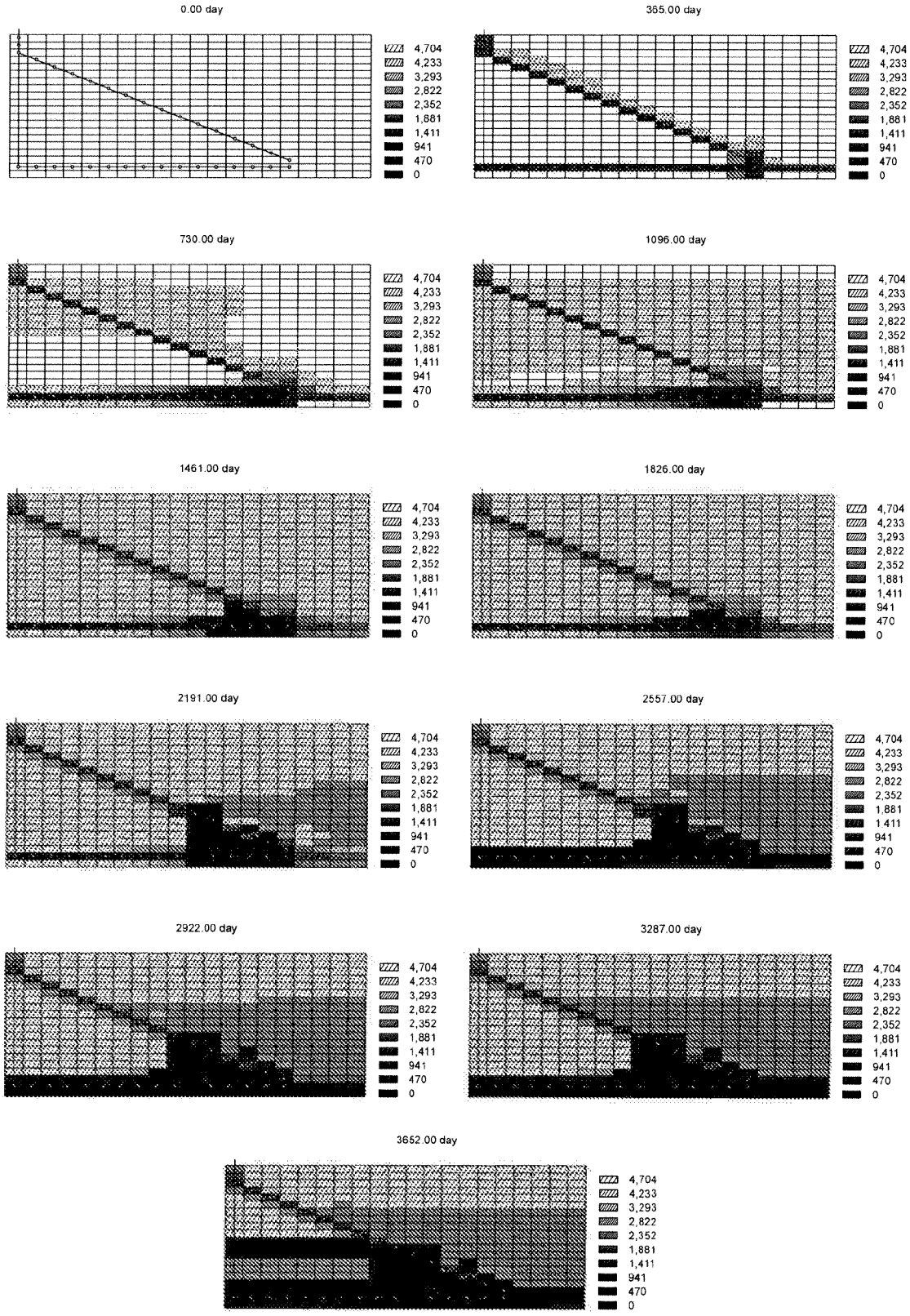
FIG. 12 illustrates the results of the CMG-STARS simulation.

FIG. 12 shows results of a simulation created using CMG-STARS. Provided by Computer Modelling Group (CMG) Software STARS=Thermal Reservoir Simulator. This third party program is an industry standard for thermal and reactive simulations of oil and gas (conventional and unconventional) reservoir recovery processes. Therefore the result of the simulations can be considered as realistic projection of the real process. FIG. 12 displays 11 annual time sequences of hydrate concentration, gmole/m3, through time as the process evolves from time 0 to the tenth year. The depleted zone starts at the location where the interwell separation is smallest and then grows along the well pair as saline water injection continues. The depletion chamber grows both along and above the production well.

Figure 13:
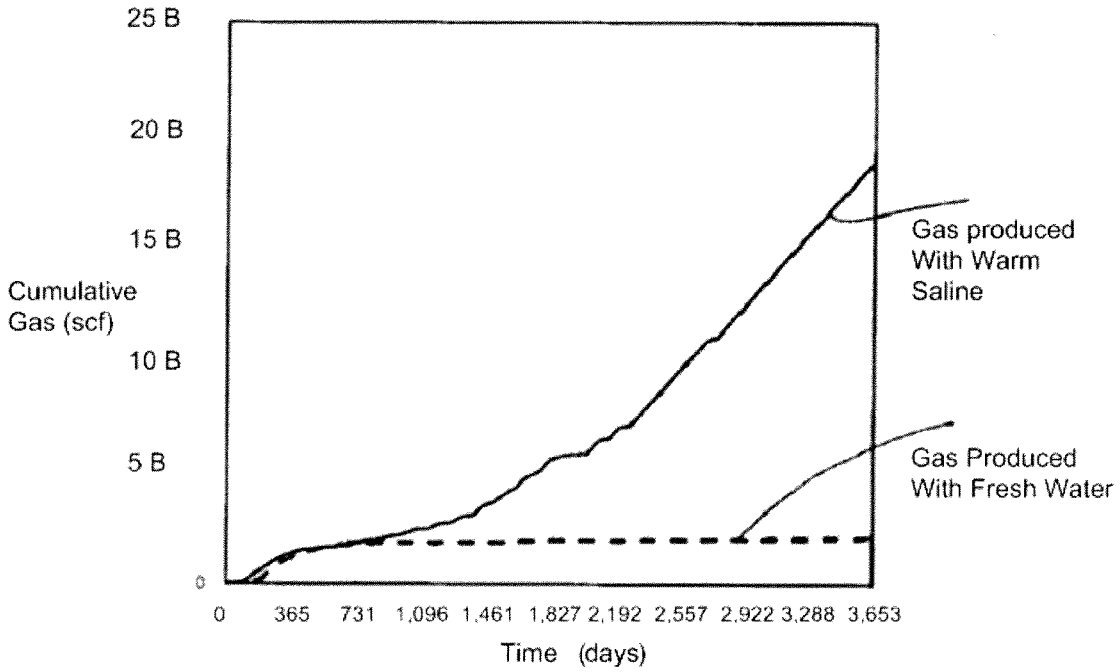
FIG. 13 illustrates the total gas extracted with use of warm saline water injection compared to fresh water injection.

FIG. 13 compares gas production under warm (5° C. above initial reservoir temperature) saline water injection with the results with warm (5° C. above initial reservoir temperature) fresh water injection. The results show that the production rate with warm saline water injection is substantially higher than that with the warm fresh water. Given the cost of heating water (by methane combustion), the heating of the injected saline water must be kept as little as possible.

During the course of the operation of the gas recovery facility there are several zones created in the reservoir. At the base of the hydrate reservoir, there is a "transition" zone created which contains water, hydrate and sediments. The injection well might be either positioned at the base of the hydrate reservoir, or ultimately it can be placed in the transition zone.

The injection rate of the water vary during the recovery process depending on the stage of the process the size and the condition of the reservoir. For injection rates (of warm saline water), the range of operation is between 1 and 2000 $m^3$/day but it is also controlled by "injectivity" of reservoir (the injection rate reservoir will accept). The injection pressures should be below the fracture pressure of the reservoir: preferred range is as low as possible while it still yields an economic production of gas.

The temperature of injected saline water, has to be sufficient to offset the heat of melting of produced hydrate. Thus the temperature of saline water has to be as low as possible to make the process economically efficient, but high enough to offset the heat of melting to make the process effective. Operational range of temperature of the water is between 1 and 20° C. above initial temperature of hydrate reservoir. However in the special cases that temperature might be as high as 40° C. above initial temperature of hydrate reservoir.

The injection pressure may vary during various stages of the operation: pressure below fracture pressure of reservoir is preferred during the regular operation, however in the initial state this pressure can be higher than original hydrate reservoir pressure so process can be started. As soon as the depletion chamber is established, then injection pressure can be lowered below original pressure of reservoir to increase the gas recovery from the hydrate by depressurization.

The pressure time lines is as following:

At the beginning of process (first 1 to 12 months):

original reservoir pressure<injection pressure<fracture pressure

After depletion chamber established (3 to 24 months) injection pressure can be above or below original reservoir pressure, but optimal condition is injection pressure<original reservoir pressure Although above provided operating timings are rough and depend on specific properties of reservoir, those timings are reasonable.

In yet further preferred embodiment the gas extraction method can be operated in acyclic manner. In this approach, the high salinity water is injected into the formation with the production well shut in. After the target pressure or volume of high salinity water is injected, the injection well is shut in and the production well is opened. The action of the high salinity water along with production will cause multiple effects including the decomposition of the hydrate plus a pressure transient that will enhance hydrate decomposition and gas production.

The method of the invention is independent of depth of the reservoir, but the depth affect the pressure for salt water injection. Also, the original pressure and temperature of the hydrate formation dictate the amount of salt required and amount of heating of the injected salt water. The method described above has to be tuned to the hydrate reservoir conditions.

In the current inventive process there is no fracture of the hydrate formation. The process does not require injection of fluids into the reservoir at pressure sufficient to fracture (crack and break) the formation. Fracturing is potentially bad fora hydrate recovery process: by fracturing the formation, a high permeability path is created in the formation which if it is not connected to a production well will potentially leak gas formed from decomposed hydrate to thief zones. For example, if a vertical fracture results, then the gas formed from hydrate will flow up the fracture potentially into overburden (going beyond a production well).

The method of the invention is very flexible and can be applied both onshore and offshore.

The key invention beyond prior art (from what we can tell from the examination of the literature) is the use of 2 or more wells (at least one injection well and one production well) to start a depletion chamber between them and then grow it within the hydrate formation by using salt water injection, temperature, and pressure control. The important feature of the invention is the use of wells that enable continuous depletion chamber growth together with gravity segregation of generated gas and water. With this capability that the production well can continuously produce generated gas from the depletion chamber (meaning that since the gas rises and liquid drains, the well must provide continuous access to the gas at the top of the depletion chamber).

Another key point is that the well configuration must provide means to remove the diluted salt water (dilution occurs from the fresh water obtained from the decomposed hydrate).

According to the process of the invention the salt water can be injected in either continuous constant or pulsed manners.

The system in the current invention has the following orientation (dimensions and angles):

a) Length of well pair L (well pair refers to the embodiment in FIG. 2 where there is a single injection well and a single production well) can be 1 to several thousand meters. Preferred length of well pair is set by the thickness of the reservoir and injection pressure required to inject water from the injection well into the formation, preferred value lies between 500 and 1000 m.

b) The inclination of the production well is also set by the thickness of the reservoir and the length of the well pair. To promote large area, extensive depletion chambers, the angle will need to be shallow (with respect to the horizontal) but it can be steep as well if required. Range of angle values from 0.5 to 70° (from the horizontal) but preferred values between 2 and 5° (from the horizontal).

c) The minimum interwell spacing (closest distance between the injection and production wells) should be <5 m. This is to ensure that the communication between the wells can be established as soon as possible. At the start of the process, hot water would be circulated in each well (this means that the wells act as line heaters in the formation). At the location of the minimum interwell spacing, the heating will decompose the hydrate and hydraulic communication will be established between the wells there first (this creates the initial depletion chamber between the injection and production wells). Once hydraulic communication is established (this period of time devoted to establishing hydraulic communication is referred to as the start-up period), then injection well is switched to warm salt water injection and the production well is converted to production. The chamber then grows along and between the well pair trajectories. This means that the only requirement is that the wells, for some interval along their trajectories, must be close enough to each other to establish hydraulic communication. Beyond the location of the minimum interwell spacing, the well trajectories can separate both vertically and horizontally to grow the depletion chamber. The interval of the wells where the minimum interwell spacing occurs can be a horizontal section between the injection and production wells of length ranging from 1 to 50 m. The preferred length would be in the range of 1 to 10 m.

d) Another aspect of the startup period is the use of methanol to help create the initial chamber between the injection and production wells.

e) The maximum interwell spacing (largest distance between the injection and production wells) is most likely set by the thickness of the hydrate formation and desired horizontal extent of the depletion chamber.

f) In reservoir where multiple well pairs are placed in the hydrate formation, the interwell pair spacing is set by the anticipated width of the depletion chamber in the formation (which is set by the vertical to horizontal permeability ratio, kv/kh, and the thickness of the hydrate formation and the horizontal trajectories of the injection and production wells). Given that gravity segregation is a major drive mechanism of the process, providing the kv/kh ratio is reasonable (>0.2), the depletion chamber will largely grow in the vertical direction unless the well trajectories force more horizontal growth. This implies that interwell pair spacing may be between 20 and 300 m with preferred values ranging from 50 to 100 m.

The operating strategy of the well pair is controlled by the flow rate, salt content, and temperature of the injected salt water and the flow rate of the production well. The pressure of the depletion chamber depends on the amount of liquid injected versus the flow rate of fluids removed from the reservoir (the production rate of gas and water). The temperature of the salt water injected into the reservoir is to offset the heat of melting of the hydrate when it decomposes thus it must at least be greater than the amount of heat losses to the earth as the salt water is pumped from surface to the hydrate zone and the amount of heat to deal with the heat of melting (can be determined by the gas production rate since the gas content of the hydrate formation could be estimated since the original pressure and temperature of the formation is known). The salinity of the injected water is set by the original salinity of the hydrate formation (and pressure and temperature)—it must be sufficient to decompose the hydrate. The salt water injectant can be obtained from sea water, sea water combined with fresh water, saline aquifer water, saline aquifer water combined with fresh water, salts added to fresh water at surface, and other productions of salt water known in the art.

Another controllable aspect is warming the salt water injected into the formation to prevent formation of hydrate in the injection well. This might happen if pressure somewhere in the injection well pushes conditions to hydrate formation side of equilibrium diagram (see FIG. 1).

Another aspect of the control strategy is the use of a movable packer in either one or both of the injection and production wells. This will promote the interval of the wells that are injecting warm salt water and producing fluids from the reservoir and help to control the depletion chamber growth in the reservoir.

Several sources of fuel required to obtained warm salt water are: small part of produced methane from decomposed hydrate, diesel or other liquid fuels brought in to field operation, geothermal heating of fluids.

It is worth noting that the diameters of the injection and production wells are not critical parts of the technology. Further the drilling of directional wells is a process known in the art.

For monitoring, standard methods can be used including temperature and pressure sensors along both wells. The salinity of the produced water will also be used to tailor the salinity of the injected water. Another monitored variable would be the produced gas to injected water ratio. Standard surface oil and gas equipment is used for the produced fluids.

Another aspect of the method described above is to propagate the well arrangement down the field (use initial well pair to establish depletion chamber and then from that point on simply place producers offset from well pair and use well pair injection well to inject warm salt water into the formation). The temperature of the injected salt water will have to compensate for heat losses associated with traveling greater distances in the reservoir.

Towards the end of the process, the depletion chamber will have reached to the top of the hydrate zone and is spreading laterally into the formation. Since much of the injected warm salt water will simply move from the injection well to the production well, the amount of gas production will be low and the process will be stopped. The revenues of the produced gas must be greater than the cost of warming and pumping salt water into the formation.

Hydrate recovery processes must provide means to enable large conformance zones within the reservoir to be economic. In other words, the decomposed zone (we call it the depletion chamber) must be large for high rates of recovery. This large vertical and area growth of the chamber is the main goal of the well configuration proposed here. Many well configurations do not have this as the main intent of the process—rather chambers would remain local to the wells. Our process, since it grows the depletion chamber along the trajectory of the well pair, provides a natural and efficient method to grow the conformance zone in the hydrate reservoir in a controlled manner.

While preferred embodiments of this invention have been shown and described, modifications thereof can be made by one skilled in the art without departing from the scope or teaching of this invention. The embodiments described herein are exemplary only and are not limiting. Many variations and modifications of the system are possible and are within the scope of the invention. For further example, the relative dimensions of various parts, the materials from which the various parts are made and operating parameters can be varied, so long as the system and methods retain the advantages discussed herein.

Accordingly, the scope of protection is not limited to the embodiments described herein, but is only limited by the claims that follow, the scope of which shall include all equivalents of the subject matter of the claims.

The invention claimed is:

1. A method to recover methane gas from an underground hydrate reservoir that has been penetrated by injection and production wells, the method comprising the steps of:

a) drilling a saline water injection well proximate the base of the hydrate reservoir;

b) drilling a substantially non parallel production well that at some location along its length is within 1 to 10 m from a part of the injection well;

c) initially injecting saline water into the production well which creates a depletion chamber between the injection and production wells;

d) varying the injection procedure for the saline water, wherein varying the injection procedure includes varying at least one of injection pressure, injection rate, temperature, or salinity, to propagate a depletion chamber in the hydrate formation resulting from hydrate decomposition; and e) extraction of gas and water from the depletion chamber through the production well.

2. The method of claim 1 further comprising the step of monitoring and varying the injection pressure and temperature to enhance propagation of the depletion chamber and extraction of gas.

3. The method of claim 1 further comprising the step of monitoring and changing the extraction rate to alter the pressure and temperature of the depletion chamber, its propagation and extraction of gas.

4. The method of claim 1 further comprising the step of monitoring and changing the salinity of the injected water to enhance propagation of the depletion chamber and extraction of gas.

5. A method according to any one of claims 1-4 where an additional step is implemented where injection is stopped and gas is continually extracted from the reservoir.

6. A method for recovery of methane gas from an underground hydrate formation comprising establishing of at least one pair of generally non parallel wells: a lower injection well and an upper production well, wherein the injection well delivers saline water to the formation and the production well recovers gas and water from the formation; wherein the injection well extends horizontally proximate a lower part of the hydrate formation and the production well extends above the injection well, while the vertical distance between the injection well and the production well vary from a minimal distance of 1 to 10 meters to a maximum distance of the thickness of the hydrate formation.

7. The method of claim 6 wherein a depletion chamber is created as a result of the operation of the well pair, starting at the point of the minimal distance between the wells.

8. The method of claim 6 wherein the heel of the production well is located proximate to the top of the hydrate deposit and its toe is located 1 to 10 meters above the toe of the injection well, while the production well extends between its heel and its toe at an angle to the injection well.

9. The method of claim 6 wherein the heel of the production well is located 1 to 10 meters above the heel of the injection well and its toe is located proximate the top of the hydrate deposit above the toe of the injection well, while the production well extends between its heel and its toe at an angle to the injection well.

10. The method of claim 6 wherein the heel of the production well is located above the heel of the injection well at a distance between 1 meter up to the top of the hydrate deposit, and the toe of the production well is located above the toe of the injection well at a distance selected from 1 meter up to the top of the hydrate deposit, the production well extends between its heel and its toe substantially non parallel to the injection well, and there is at least one intermediate segment of the production well positioned between the heel and the toe which is located 1 to 10 meters from the injection well.

11. The method of claim 10 wherein the angle between the production well and the injection well varies between the head of the well to the toe of the well, therein there is one angle before the intermediate point and another angle beyond it.

12. The method of claim 6 or 7 wherein heated saline water is injected into the injection well and the produced gas and water are retrieved from the production well.

13. The method of claim 12 wherein in one step of the process the output of the production well is shut, and only the injection well is operable, while in an another step the inlet to the injection well is shut, and only the production well is operable.

14. A process for extracting methane gas from a hydrate deposit, the process comprising the following steps:

drilling two generally non parallel wells: a lower injection well and an upper production well, injecting into the lower well heated saline water to create a depletion chamber, waiting for separation of the gas and water phases, extracting of the gas and water from the deposit, separating the gas from the water, and reusing the water for further injection.

15. The process in claim 14 wherein the lower well extends substantially horizontally at the bottom of the hydrate deposit, and the upper well extends at an angle to the lower well, and the vertical distance varies from 1 meter up to the top of the hydrate deposit, and in this way gas can be extracted from any location in the depletion chamber.

16. A system for extracting methane gas from a hydrate deposit, the system comprising an injection well, a production well, a water injecting unit, and a gas collecting unit, said injection well extending vertically from the injection point toward the bottom of the hydrate deposit and then extends horizontally along the hydrate deposit's bottom, said production well extends vertically from the ground to the top of the hydrate deposit and then extending in a non parallel direction above the injection well; at least one segment of the production well being located proximate the injection well and the balance of the production well being positioned in the hydrate deposit remote from the injection well; the water injecting unit being attached to the injection well and the gas collecting unit being attached to the production well.

17. The system, process or method of claim 1, 6, 14 or 16 further comprising a movable packer in the production well.

* * * * *